US006338309B1

(12) United States Patent
Michelson

(10) Patent No.: US 6,338,309 B1
(45) Date of Patent: Jan. 15, 2002

(54) INBOARD MOTORBOAT BILGE DRAINAGE SYSTEM

(76) Inventor: Gary K. Michelson, 438 Sherman Canal, Venice, CA (US) 90291

( * ) Notice: Subject to any disclaimer, the term of this patent is extended or adjusted under 35 U.S.C. 154(b) by 0 days.

(21) Appl. No.: 09/354,281

(22) Filed: Jul. 15, 1999

Related U.S. Application Data

(63) Continuation-in-part of application No. 09/245,009, filed on Feb. 4, 1999.

(51) Int. Cl.[7] ..... B63B 13/00
(52) U.S. Cl. ..... 114/183 R; 114/197
(58) Field of Search ..... 114/183 R, 197

(56) References Cited

U.S. PATENT DOCUMENTS

| | | | | |
|---|---|---|---|---|
| 1,866,643 A | * | 7/1932 | Greear | 114/197 |
| 2,997,975 A | * | 8/1961 | Moeller | 114/183 R |
| 3,036,541 A | | 5/1962 | Musick et al. | |
| 3,565,031 A | * | 2/1971 | DePersia | 114/183 R |
| 3,757,726 A | * | 9/1973 | Moeller | 114/183 R |
| 3,812,810 A | * | 5/1974 | Moeller | 114/197 |
| 4,019,454 A | | 4/1977 | Landwerlen | |
| 4,217,846 A | | 8/1980 | Wight | |
| 4,495,963 A | * | 1/1985 | Hensley | 137/351 |
| 4,516,515 A | | 5/1985 | Johnson | |
| 4,667,616 A | | 5/1987 | Mahon | |
| 4,693,690 A | | 9/1987 | Henderson | |
| 4,702,457 A | * | 10/1987 | Lew et al. | 251/161 |
| 4,932,348 A | | 6/1990 | Nix et al. | |
| 4,986,206 A | | 1/1991 | Knight et al. | |
| 4,986,777 A | * | 1/1991 | Preston | 440/88 |
| 5,018,470 A | * | 5/1991 | Mitchell et al. | 114/183 R |
| 5,047,753 A | * | 9/1991 | Birchfield | 340/984 |
| 5,048,556 A | | 9/1991 | Grumelot et al. | |
| 5,083,521 A | | 1/1992 | Widing | |
| 5,123,369 A | | 6/1992 | Gross | |
| 5,130,708 A | | 7/1992 | Boyden | |
| 5,182,556 A | | 1/1993 | Plost et al. | |
| 5,265,551 A | | 11/1993 | Rosenblad | |
| 5,357,247 A | | 10/1994 | Marnel et al. | |
| 5,385,108 A | | 1/1995 | Thompson | |
| 5,460,111 A | | 10/1995 | Frahn | |
| 5,576,582 A | | 11/1996 | White | |
| 5,636,586 A | | 6/1997 | Suganuma | |
| 5,724,908 A | | 3/1998 | Murray | |

* cited by examiner

*Primary Examiner*—S. Joseph Morano
*Assistant Examiner*—Andrew D. Wright
(74) *Attorney, Agent, or Firm*—Martin & Ferraro, LLP

(57) ABSTRACT

An improved bilge drain system for an inboard motorboat is disclosed having a drain closure assembly that is operated from a position external to the engine compartment. The drain closure can be a valve operable by a handle, wherein the handle is accessible outside of the engine compartment when closed by an engine compartment cover. The handle, which may be located adjacent to the engine compartment or on a dashboard of the motorboat, may also be configured to provide the user with a visual indication of the open and closed status of the drain closure.

30 Claims, 10 Drawing Sheets

INBOARD MOTORBOAT BILGE DRAINAGE SYSTEM

This application is a continuation in part of application Ser. No. 09/245,009, filed Feb. 4, 1999, of Gary K. Michelson, M.D. for An Improved Inboard Motorboat Bilge Drainage System.

BACKGROUND OF THE INVENTION

1. Field of the Invention

This invention relates to inboard motorboats and, specifically, to an improved bilge drainage system for use within an inboard motorboat.

2. Description of the Related Art

Recreational boats frequently are powered by an inboard motor located in part below the boat's internal flooring. In this type of vessel, the motor is generally enclosed in a covered engine compartment having a hinge at the base of a cover to provide access to the engine and related components.

A drain is provided for drainage of the engine compartment and/or of the interior of the boat generally. The boat's interior is configured so that water in it flows to the drain by force of gravity. The drain is normally tamped with a removable, generally threaded, plug, which may be generally about an inch in diameter. The plug is manually removed when drainage is required, but must of course, be replaced prior to placing the boat in the water. Failure to replace the drain plug prior to placing the boat into water would result in flooding of the engine compartment and eventual swamping of the boat. Unfortunately, it is not an unheard of occurrence that the operator forgets to replace the plug into the drain hole prior to launching the boat, and suffers the above undesirable consequences. In part, this is because the described type of drain is located near or more often beneath a portion of the engine within the enclosed engine compartment, making the open/closed status of the drain unapparent and, in either event, hidden from view by the engine compartment and cover. Even when the operator remembers to insert the plug, the location of the plug under the engine makes access an inconvenient and sometimes messy job, and possibly dangerous, such as when the engine is hot or actually running.

Equally undesirable is forgetting to remove the drain plug when, for example, the boat is in unprotected storage where it could be flooded by a rain shower. Damage to the boat's electronics, motor or interior could result from allowing water to accumulate inside the boat undrained. Finally, the removable plug, being a separate component, may be lost or misplaced, meaning that the boat cannot be operated until a replacement has been obtained.

Needed, therefore, is an improved design for a boat drainage system that makes opening and closing the drain more convenient and more easily visualized.

SUMMARY OF THE INVENTION

The present invention is directed to an improved inboard motorboat boat bilge drainage system having a drain closure that is operable from a position outside of the engine compartment of the motorboat. Preferably, a handle for operating the drainage system is located to be accessible outside of and adjacent the covered portion of the motor compartment and is accessible with the engine compartment cover closed.

In a further improvement, the screw-in and screw-out drain plug of the prior art is replaced by a drain closure valve that preferably goes from a fully open position to a fully closed position in approximately one quarter to one-half of a turn of the handle, and still further the handle is able to function as a visual indicator of the drain status. The shaft of the handle may at an angle that is not perpendicular to the horizontal plane of the floor of the boat such that the drain closure status is made more conspicuous by the protrusion of at least a portion of the handle above the floor when the drain is open, and the handle turned up.

In one embodiment of the present invention, the bilge drain is located external to the engine compartment covered by an engine compartment access cover and adjacent thereto and has a drain closure assembly associated with the drain. The drain closure may include a valve assembly operable by a handle. The outlet of the bilge drain through the hull of the boat is no longer within the engine compartment proper, but is rather beneath the floor area of the boat, adjacent the engine compartment, and in communication with the engine compartment. The drain closure, be it a threaded plug or a valve, is conveniently accessible without the need to enter and go through the engine compartment access cover. The best place for the bilge drain opening is near the lowest point along the hull to permit drainage by gravity. The bilge drain opening may also be used for draining motor oil, such as through a hose fed through the drain, to the outside of the boat, which is most convenient if the drain is near the motor.

The bilge drain in this embodiment of the present invention, is located in an area where it does not interfere with craft operations, and, preferably, in a well formed through the floor of the boat above the hull and with potential access out the hull to the outside of the boat below the hull. Because the engine compartment still must be drained, a channel to the bilge drain (compartment extension) is provided.

In further embodiments of the present invention, the bilge drain remains in its conventional location within the engine compartment and a drain closure assembly that is operable from a position external to the engine compartment is used to open and close the bilge drain. In a preferred embodiment, the bilge drain assembly includes a valve that can be operated to allow or prevent drainage through the bilge drain, but that is not removed in ordinary operation. The valve itself can be in a housing, and a valve stem handle is both accessible and visible without opening the engine compartment cover. To further increase visibility, the valve stem may be at an angle that is not perpendicular relative to the horizontal plane of the floor of the boat so that at least a portion of the handle protrudes above the boat floor, and is thus highly visible when the valve is in the open position.

In yet further embodiments of the present invention, a rotational drive of the valve at an angle is utilized to open and close the valve. Preferred embodiments of the rotational drive include an articulated coupling or a flexible connector interconnecting the handle and valve.

In a further embodiment, operation of the drain closure assembly also opens and closes an electrical circuit that can be used to activate an alarm or indicator light to signal the open or closed condition of the drain closure, or even to prevent the ignition circuit from being closed, without performing some override operation.

OBJECTS OF THE PRESENT INVENTION

An object of the invention is to provide a drain system that is both simple and convenient to use.

Another object of the invention is to provide a boat drainage system that is operable without accessing the engine compartment.

Yet another object of the invention is to provide boat bilge drainage that eliminates the necessity of removing the bilge plug that could become lost.

Yet another object of the invention is to provide an improved drainage system that can be operated in a manner that is safer, simpler, and cleaner when compared to conventional systems.

A further object of the invention is to provide an improved drainage system that employs a visual indication of the status of the boat's drainage aperture.

A still further object of the invention is to provide an alarm to alert a vessel operator if a drain is not properly closed.

DETAILED DESCRIPTION OF THE DRAWINGS

The present invention will now be described more fully with reference to the accompanying drawings, in which preferred embodiments of the invention are shown by way of example only, and not limitation. This invention may, however, be embodied in many different forms and should not be construed as limited to the embodiments set forth herein; rather, these embodiments are provided so that this disclosure will be thorough and complete, and will fully convey the scope of the invention to those skilled in the art. Novel features of the present invention may be combined from the teachings of the various embodiments.

Figure 1:
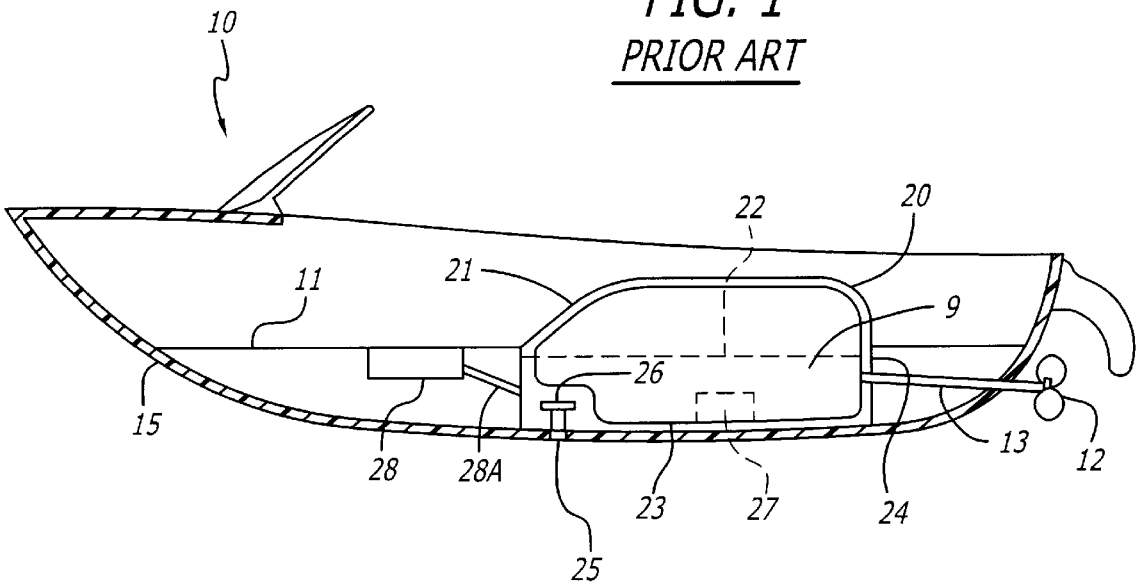
FIG. 1 PRIOR ART
FIG. 1 is a side elevational view of an inboard motorboat in partial cutaway illustrating a typical configuration of a bilge drain and plug of the prior art.

FIG. 1 shows in outline form a conventional inboard motorboat of the prior art, generally designated by the reference numeral 10, having a hull 15, a portion of which is shown in partial cut-away and in cross section. The interior of boat 10 contains an engine compartment 20 within which is an in-board engine 22 used to provide power to drive a propeller 12 via a transmission 9 and shaft 13. Engine compartment 20 is shown with its cover 21 in the lowered position. Engine 22 may be disposed in an engine pan 23, which may form the lower portion of engine compartment 20 along hull 15. Cover 21 may be connected by a hinge 24 to the lower portion of engine compartment 20 so that an operator, e.g., standing on a floor 11 of boat 10, can raise cover 21 to access the interior of engine compartment 20. A bilge drain 25 is formed through pan 23 (if present) and hull 15 within engine compartment 20. Drain 25 is normally located at a low point of the boat hull's interior, commonly referred to as the bilge. Drain 25 allows water accumulated in boat 10 to be removed when boat 10 is out of the water.

Figure 2:
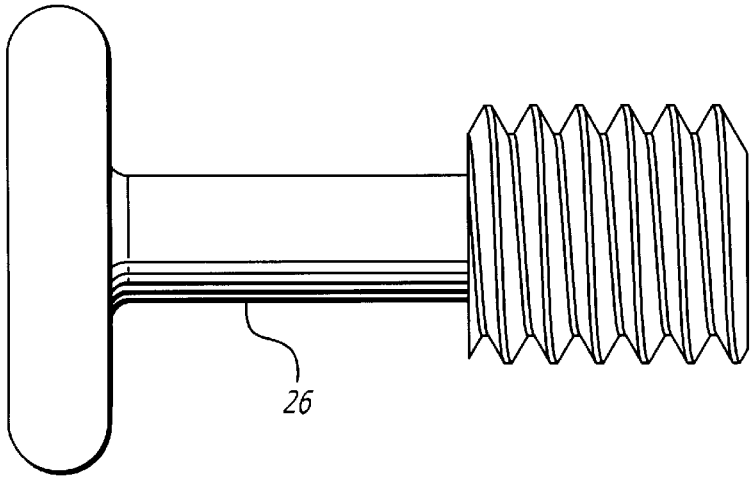
FIG. 2 PRIOR ART
FIG. 2 is a side elevational view of a typical bilge drain plug of the prior art used in the boat of FIG. 1.

As shown in FIGS. 1 and 2, drain 25 typically has a threaded opening that must be closed by prior art plug 26, prior to placing boat 10 into the water. When out of the water, it is advisable to remove plug 26 so that all accumulated water therein can drain. Before puffing boat 10 back into the water, it is necessary to replace plug 26 so that water does not enter through drain 25, flooding and swamping boat 10. Although many water craft of this type are equipped with a bilge pump 27 to pump accumulated water out of the water craft, an adequate drain system is still required so that water can be removed when bilge pump 27 is not in operation, and for complete hull drainage. Bilge pumps also may not protect the boat from being flooded during a heavy rain. Boat 10 may also have an ice chest 28 with a downwardly sloping outlet drain 28A to engine compartment 20, preferably near the low point of boat 10, and drain 25. In this manner, water can drain out of ice chest 28 through outlet drain 28A to the engine compartment and out of boat 10 through drain 25 when plug 26 is removed or bilge pump 27 is engaged. The boat may be so constructed to allow water from other areas within the boat to also drain to the bilge area.

Drain 25 and plug 26 of the prior art are problematic in that operators of boat 10 desiring to access drain 25 must lift cover 21 and reach down into engine compartment 20, risking injury from exposure to the components of the engine (whether in operation or not), such as the fan, and fan belt, such as being burned by a hot motor after operation, or at the very least risk becoming dirty and greasy from oil and dirt present on the engine components.

The improved bilge drainage system of the present invention eliminates the risks and inconvenience present in the prior art inboard motorboats 10, such as illustrated and described in connection with FIGS. 1 and 2. Moreover, the drain plugs of the prior art were hidden from view so that an operator of the boat would be unaware of the status of the drain plug, i.e., whether the drain was open or closed, with engine compartment cover 21 closed.

Figure 3:
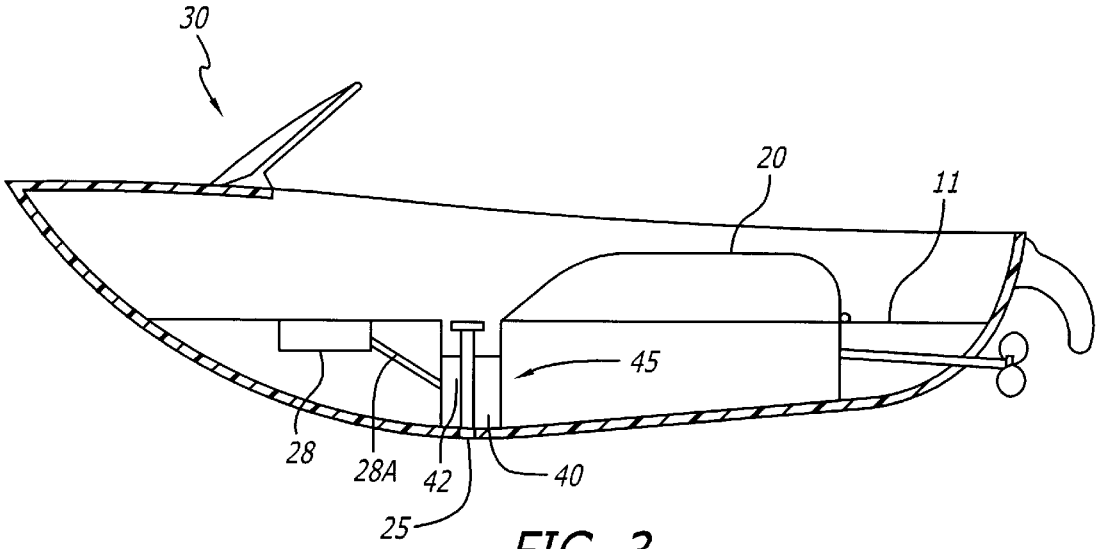
FIG. 3 is a side elevational view of an inboard motorboat in partial cutaway illustrating a first embodiment of the improved bilge drainage system of the present invention.
Figure 6:
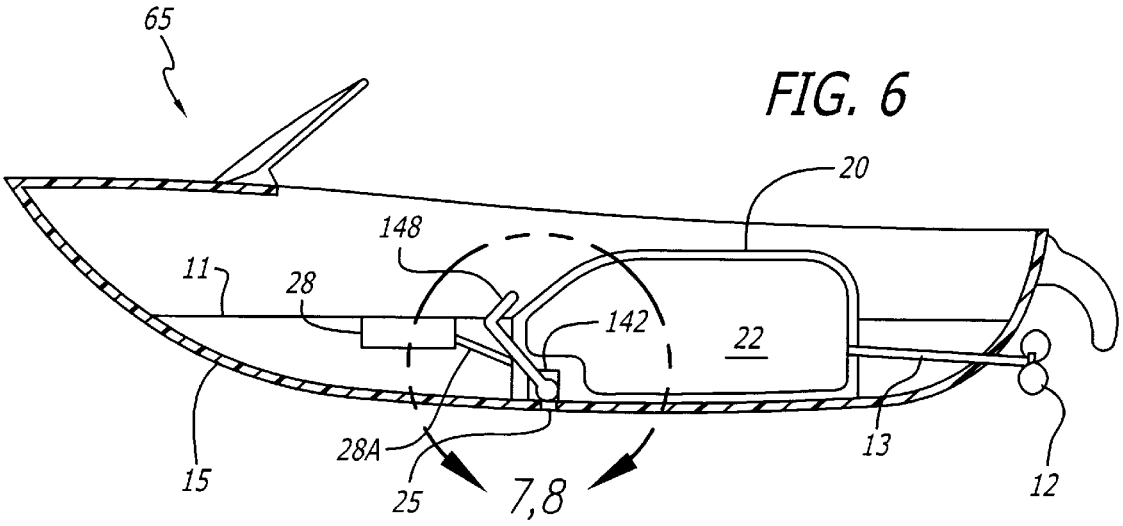
FIG. 6 is a side view of an inboard motorboat in partial cutaway incorporating a second embodiment of the improved bilge drainage system of the present invention.
Figure 4:
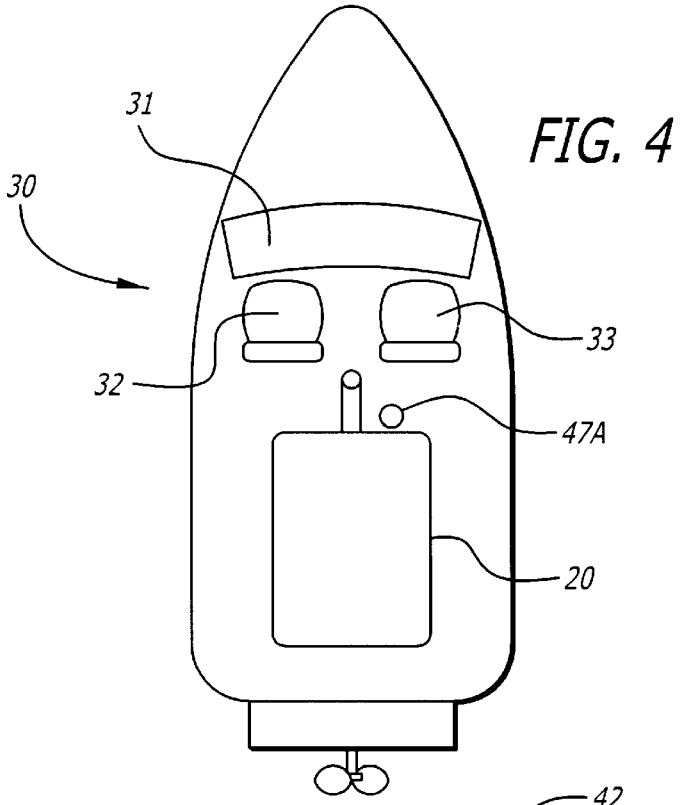
FIG. 4 is a top plan view of an inboard motorboat with a first embodiment of the improved bilge drainage system of the present invention.
Figure 5:
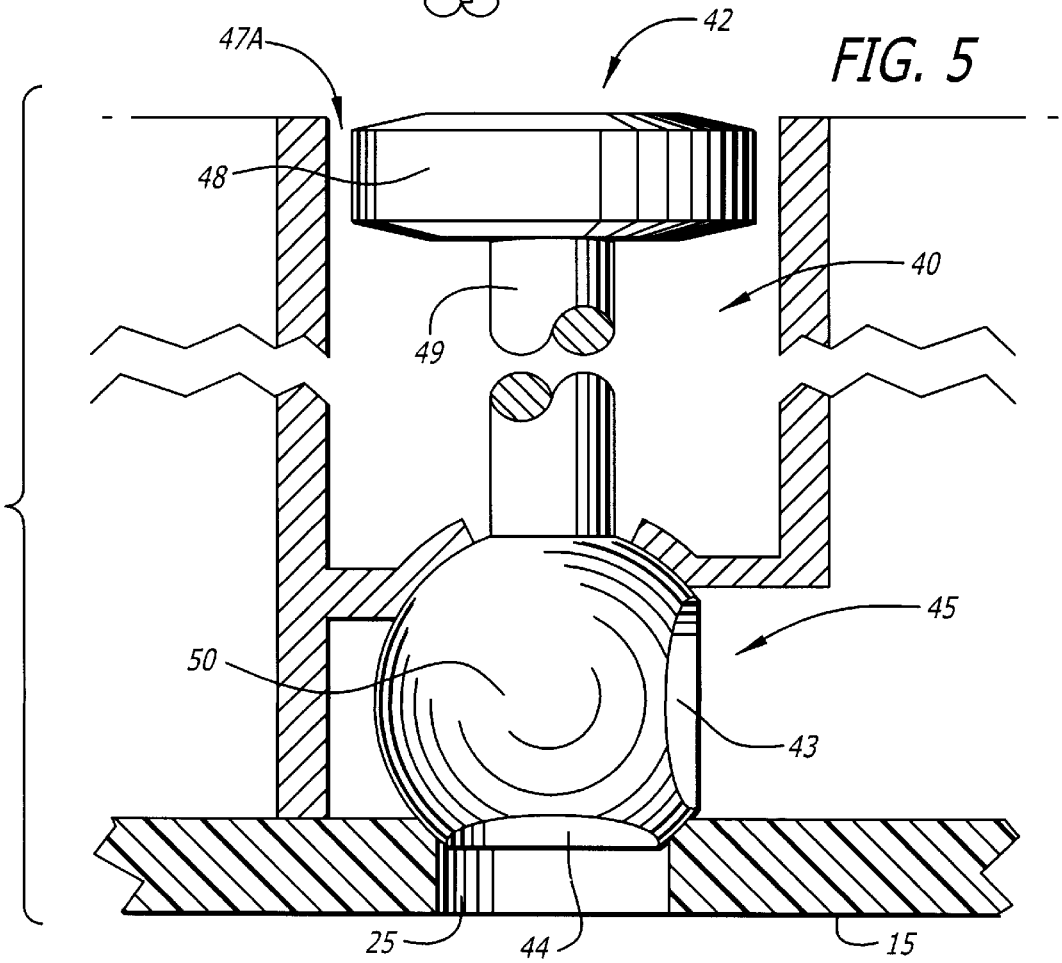
FIG. 5 is a side view of a valve well in partial cross section and valve components in an open configuration pursuant to a first embodiment of the bilge drainage system of the present invention.

With reference to FIGS. 3–5, a boat in accordance with a first embodiment of the present invention is shown and generally referred to by the numeral 30. Boat 30 includes an improved bilge drainage system that overcomes the aforementioned difficulties encountered with conventional inboard motorboat bilge drain and plug configurations. Boat 30 has a drain 25 that is located external to engine compartment cover 21 and adjacent thereto and may be within a separate housing or protective well 40 from engine compartment 20, as shown in detail in FIG. 5. Well 40 permits easy hand access to a drain closure assembly, generally referred to by the reference numeral 42, for opening and closing drain 25. Well 40 is preferably configured to be water tight and may be configured to provide for sound proofing. Well 40 may also have a see-through portion to permit inspection of the water level in the bilge.

With reference to FIG. 5, while drain 25 may be closed by a thread-in plug, in one embodiment of the present invention the drain closure assembly includes a valve apparatus 42 located within protective well 40, having a ball valve 50 that is coupled to drain 25 and has an outlet opening 44 in communication with drain 25 and an inlet opening 43. When valve apparatus 42 is in the open position (as shown in FIG. 5), inlet opening 43 is facing toward and is in communication with intake port 45. In this position, water can flow through intake port 45 into inlet opening 43, through ball valve 50, out outlet opening 44, and exit boat 30 through drain 25. When valve apparatus 42 in the closed position, inlet opening 43 is facing away from and is not in communication with intake port 45. In this position, water cannot flow into inlet opening 43 and water cannot enter boat 30 from drain 25. Valve apparatus 42 is moved from the closed to open position by rotation of ball valve 50 such that inlet opening 43 is offset adequately from intake port 45, which is maximized when ball valve 50 is rotated 180 degrees.

Well 40 has a hand hole 47A through which a boat operator may access a handle 48 attached to valve apparatus 42. Handle 48 may be as shown, or may be a "T"-shaped handle, or a knob, or any other configuration suitable for use in its intended purpose. A valve stem 49 connects handle 48 to ball valve apparatus 50. Valve stem 49 and handle 48 are so configured that when valve apparatus 42 is in the closed position, the position of handle 48 is such that it is entirely below the level of floor 11 of boat 30, hiding handle 48 from view when all is well, i.e., valve apparatus 42 is closed and boat 30 is watertight. It should, of course, be understood that although in a preferred embodiment, handle 48 is flush with a surface indicating closure and safety, handle 48 may instead protrude in a particular manner to indicate the open/closed status, e.g., using indicia to indicate the instant state of the valve apparatus 42.

Since protective well 40 is not within engine compartment 20, an intake port 45 in connection with engine compartment 20 is provided so that water or other fluids may flow from within engine compartment 20, and from engine pan 23 to and through valve apparatus 42. It should be understood that additional openings may be strategically placed so that water or other fluids from any location inside boat 30 can be channeled and removed through drain 25. For example, outlet drain 28A of ice chest 28 as shown in FIG. 3 can empty into protective well 40, preferably adjacent to inlet opening 43 of valve apparatus 42. Additionally, valve apparatus 42 is configured such that a hose may be inserted from engine compartment 20 through intake port 45 and then through drain 25 to drain, motor oil, or other fluids from within boat 30.

The sizes of inlet opening 43 and outlet opening 44 of ball valve 50 may be selected to be consistent with the aperture of drain 25 and ball valve 50 then being adequately sized to operate properly (seal and open) with the given size of inlet and outlet openings 43 and 44.

Although valve apparatus 42 is shown to include a ball valve 50, other types of valves, for example, a cone valve or other type of valve may prove just as suitable. When the cone valve is rotated even a small number of degrees about its axis, all fluid flow will stop therethrough by misaligning the valve inlet opening with the intake port. Alternatively, a threaded valve could be used having a multi-point lead and that opens and closes by screwing up and down such that less than one full turn is required to open the valve far enough to permit adequate drainage. It is appreciated that use of prior art drain plugs or other types of removable plugs would still be within the scope of this embodiment of the present invention.

With reference now to FIGS. 6–10, there is illustrated another embodiment of the present invention which overcomes the aforementioned difficulties encountered with the prior art inboard motorboat configurations while leaving the drain opening unmoved from its prior art location. In the configuration of boat 65, in accordance with this embodiment drain 25 remains in its conventional position internal to engine compartment 20. A drain closure assembly including a valve assembly 142 is in communication with drain 25 and operates to open and close drain 25. Valve assembly 142 is similar to valve assembly 42 disclosed in connection to FIGS. 3–5, except that handle 148 extends from a shaft 149 that may be at an angle to the central longitudinal axis of the drain 25. Shaft 149 extends from ball valve 150 through an aperture in the engine compartment wall such that handle 148 is positioned adjacent to, but outside of, engine compartment 20. The orientation of handle 148 in this position permits the operation of valve assembly 142 from a position external to engine compartment 20. Similarly, drain 28A from ice chest 28 drains into engine compartment 30 through anterior aperture in the engine compartment wall.

Figure 7:
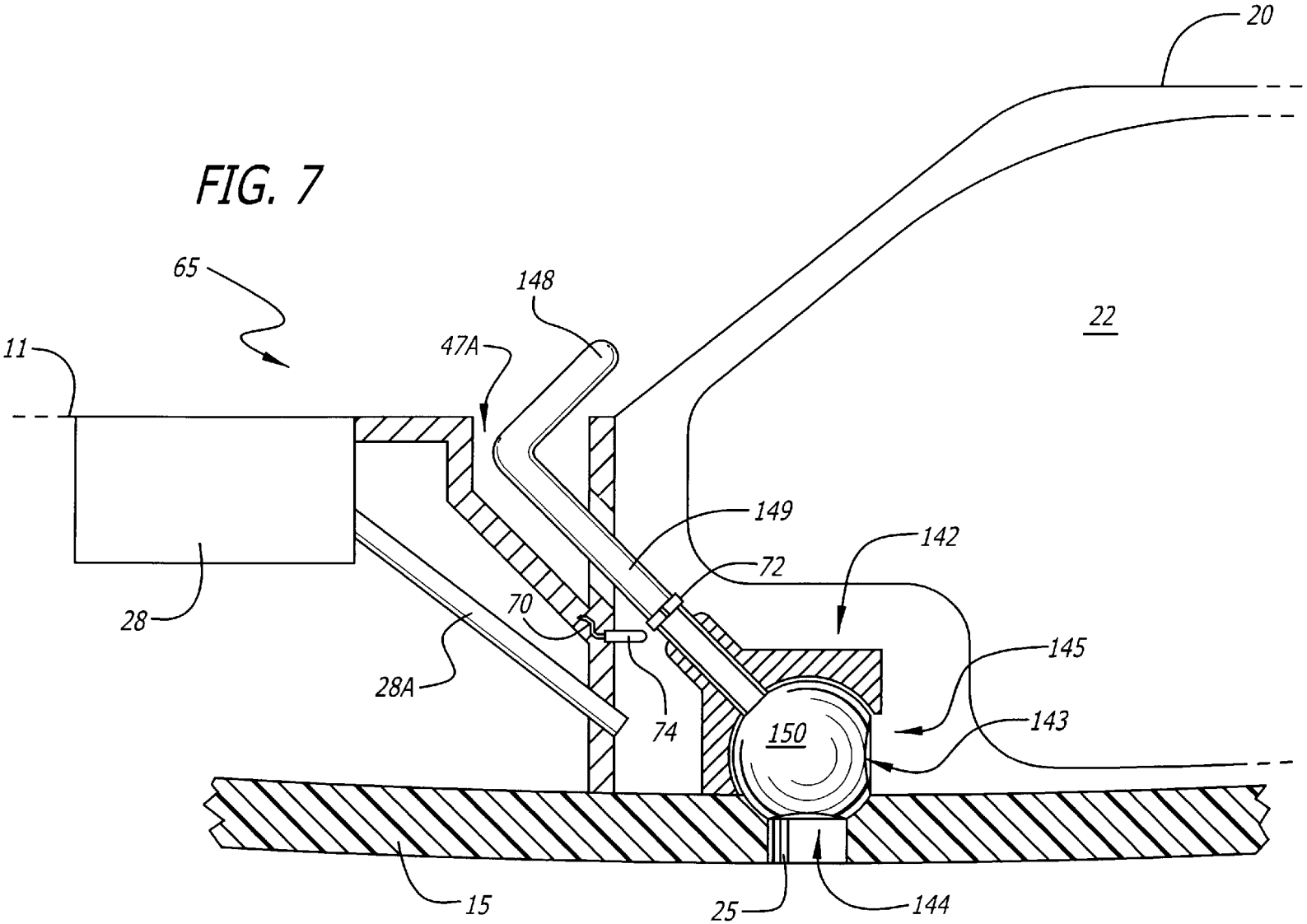
FIG. 7 is an enlarged side view along line 7, 8 of FIG. 6 of a valve well in partial cross section and valve components in an open configuration pursuant to a second embodiment of the bilge drainage system of the present invention.

As shown in FIG. 7, it is preferred that when valve apparatus 142 is open, valve handle 148 is rotated to a position where at least a portion thereof protrudes out of well 40 or above the plane of floor 11, clearly flagging the open status through hand hole 47A. The upwardly-turned handle 148 can readily be seen and alerts an operator that valve apparatus 142 is open. Handle 148 may be brightly colored to provide a further visible indicator that valve apparatus 142 is open. A top view of handle 148 in its open position can be seen in FIG. 9. shown in FIG. 8, when handle 148 is in a closed position, it is oriented so as to be flush with or below floor 11 within protective well 40. To close valve apparatus 142, handle 148 is rotated approximately 90 degrees in either direction such that inlet opening 143 is offset with intake port 145 opening and the intake port is blocked by the remainder of ball valve 150. It is appreciated that ball valve 150 may be rotated more or less than 90 degrees to close intake port 145 as long as a portion of ball valve 150 sufficient to block port 145 is positioned to close intake port 145. A top view of handle 148 in one of its closed positions can be seen in FIG. 10.

Ball valve 150 has a diameter that is preferably, approximately twice the diameters of each of intake port 145 and drain 25. For example, intake port 145 may have a diameter of approximately 1⅛ inches and ball valve 150 may have a diameter of approximately 2¼ inches. Inlet opening 143 and outlet opening 144 have a diameter that approximates the diameter of intake port 145 and drain 25, respectively.

It should, of course, be understood that any number of valve types may be employed to implement the functionality of the present invention and the scope of the present invention should not be limited to the illustrative examples set forth herein.

Additionally, an alarm activation mechanism, generally designated by the reference numeral 70, may be provided to warn the boat operator that drain 25 is open, and an audible alarm and/or a flashing light would result when the key is placed in the ignition if valve apparatus 142 is in an open position. In an alternative embodiment, engine 22 does not start at all until valve apparatus 142 is closed or a manual override procedure is executed. Any number of alarm activation means may be utilized without departing from the present invention and only one is shown by way of example only. The alarm activation mechanism 70 includes a protruding alarm tab 72 affixed to valve stem 149 of valve apparatus 142.

Figure 8:
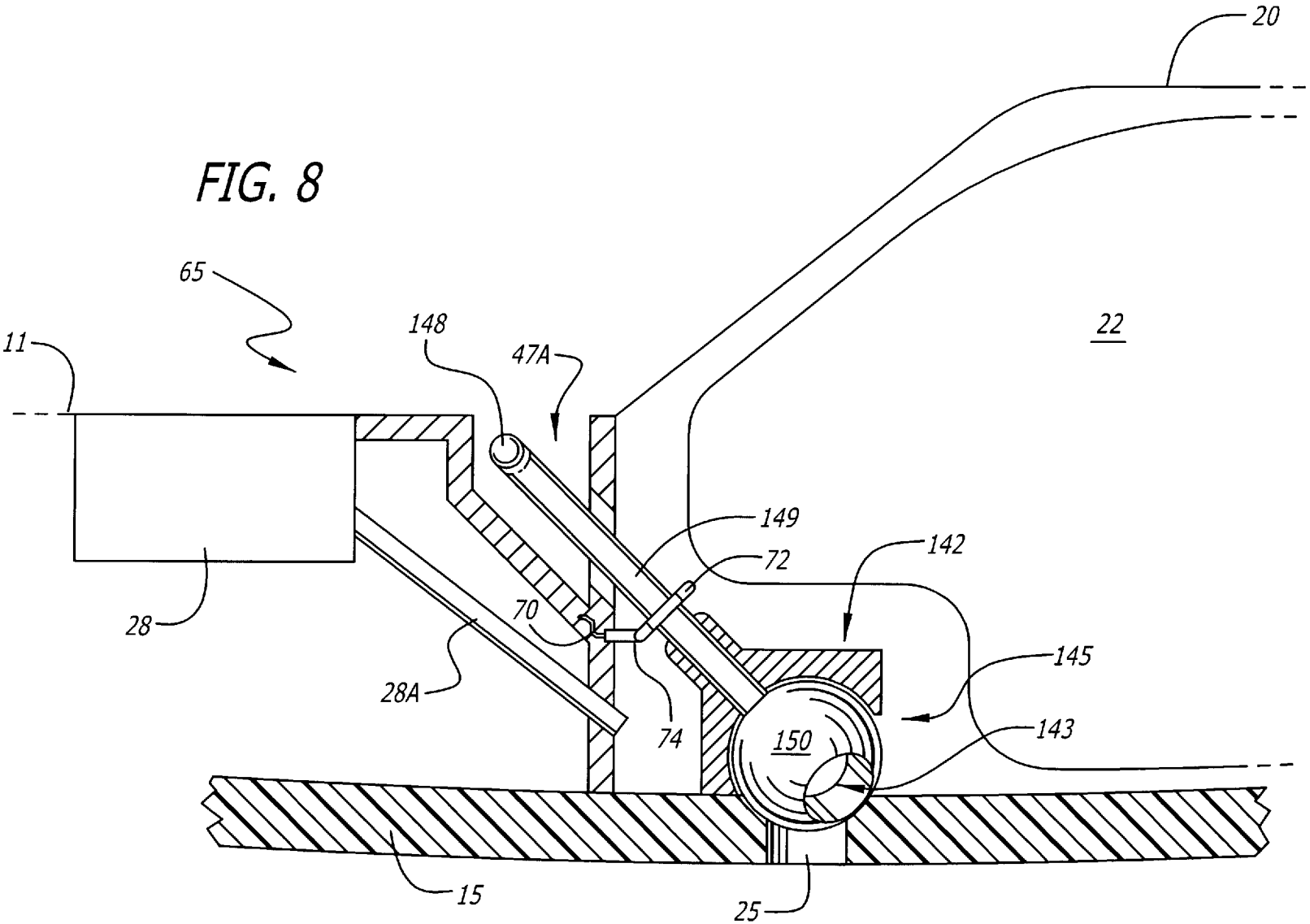
FIG. 8 is an enlarged side view along line 7, 8 of FIG. 6 of a valve well in partial cross section and valve components in a closed configuration pursuant to a second embodiment of the bilge drainage system of the present invention.
Figure 9:
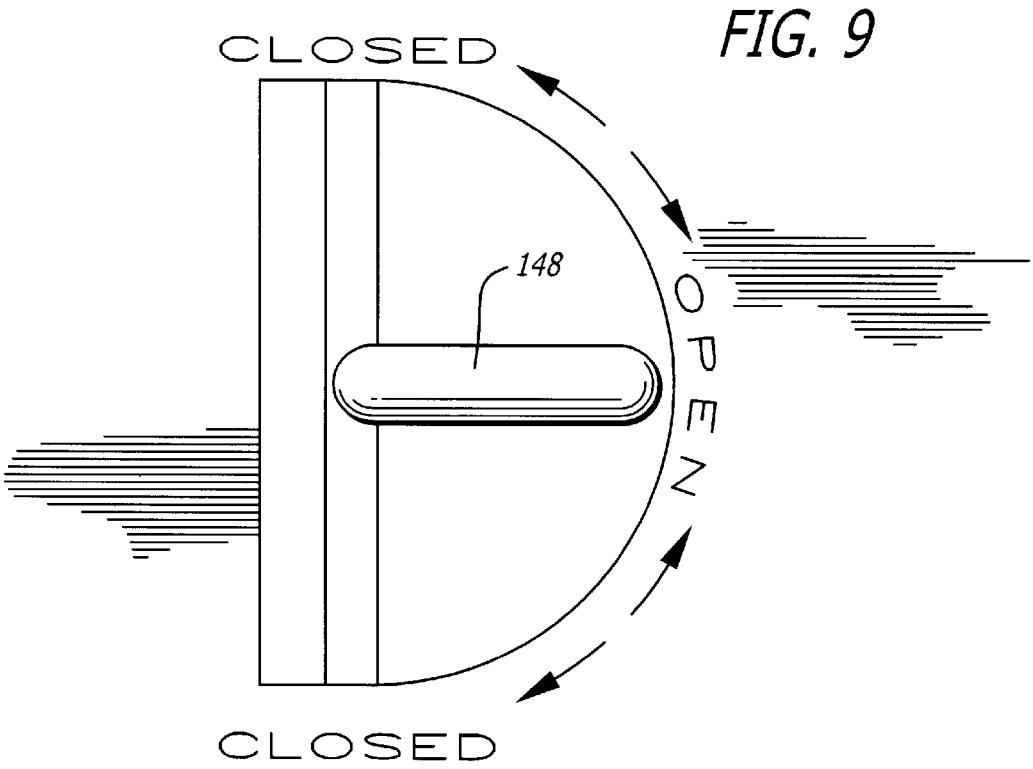
FIG. 9 is a top plan view of the valve well and valve components shown in FIG. 7.
Figure 10:
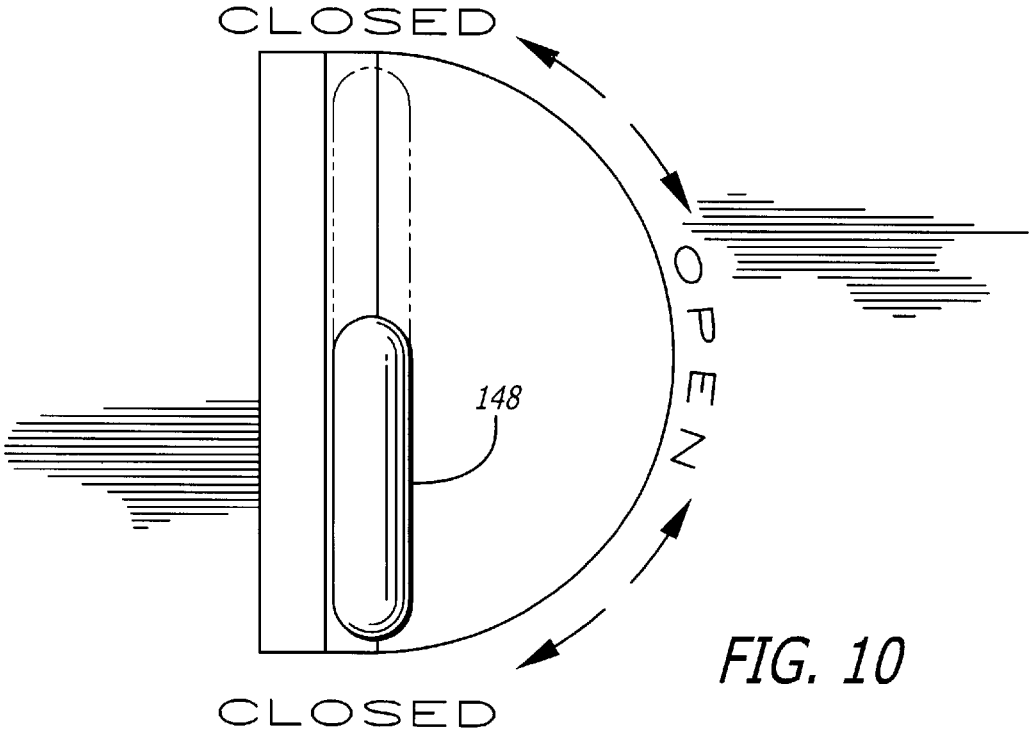
FIG. 10 is a top plan view of the valve well and valve components shown in FIG. 8.

As shown in FIG. 8, when valve apparatus 142 is fully closed, alarm tab 72 deflects an alarm actuator arm 74 from a straight-on position. When handle 148 is moved from a fully closed position, such as the fully open position illustrated in FIG. 7, alarm actuator arm 74 is armed or active upon deflection back to its straight-on position to sound an alarm when the key is inserted into the ignition. It should be readily apparent to one skilled in the art that many variations on the alarm mechanism are possible.

Further embodiments of the present invention will now be described wherein a rotational drive of the valve assembly at an angle is utilized to allow the handle to open and close the valve assembly.

Figure 11:
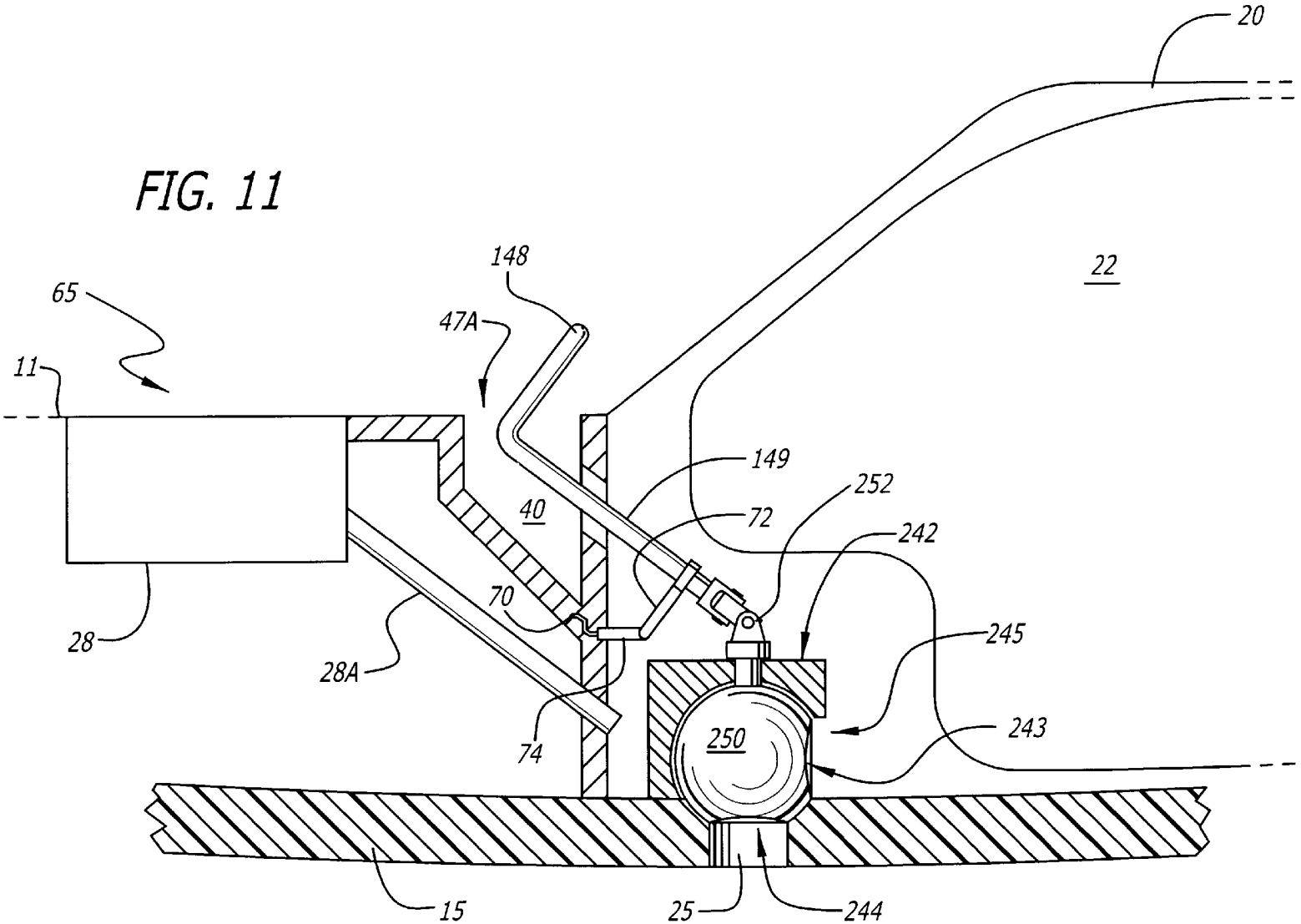
FIG. 11 is an enlarged side view of a valve well in partial cross section and valve components in an open configuration pursuant to a third embodiment of the bilge drainage system of the present invention.
Figure 12:
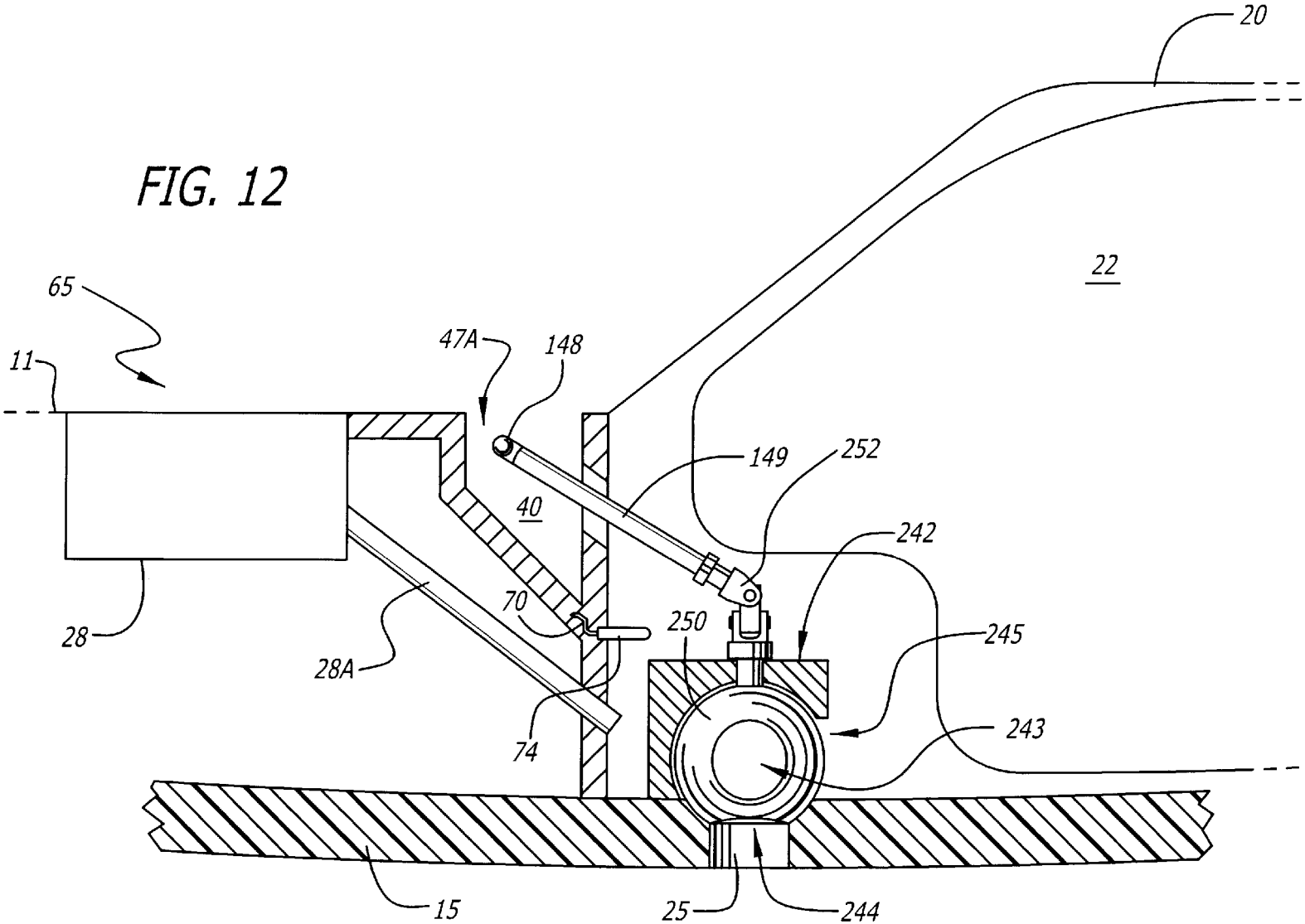
FIG. 12 is an enlarged side view of a valve well in partial cross section and valve components in a closed position pursuant to a third embodiment of the bilge drainage system of the present invention.

Thus, with reference to FIGS. 11 and 12, there is illustrated a further embodiment of the present invention which leaves the drain opening unmoved from its prior art location. In this regard, the embodiment here has certain similarities to the embodiment previously described in conjunction with FIGS. 6–10. Thus, drain 25 remains in its conventional position internal to engine compartment 20. A drain closure assembly including a valve assembly 242 communicates with drain 25 and operates to open and close drain 25. Valve assembly 242 is similar in many respects to valve assembly 142 disclosed in connection with FIGS. 6–10, except that shaft 149 is connected to ball valve 250 through an articulated coupling 252 at a position that is co-axial with drain 25 and outlet opening 244 of ball valve 250, and perpendicular to inlet opening 243 of the ball valve. Rotation of handle 148 and hence shaft 149 thus causes articulated coupling 252 to rotate ball valve 250 such that inlet opening 243 rotates circumferentially into and out of alignment with intake port 245.

An additional advantage provided by this particular embodiment of the present invention is that it permits the use of a common and readily available commercial ball valve in valve assembly 242. Such a commercial ball valve is characterized by an L-shaped or elbow-shaped passageway connecting inlet opening 243 and outlet opening 244.

As shown in FIG. 11, when valve assembly 242 is open, inlet opening 243 aligns with intake port 245 and outlet opening 244 aligns with drain 25. Further, handle 148 rotates to a position where at least a portion thereof protrudes above the plane of floor 11. The open status of the valve assembly is thus indicated in the same manner as described with relation to the embodiment of FIGS. 6–10. As shown in FIG. 12, when valve assembly 242 is closed, inlet opening 243 circumferentially rotates out of alignment with intake port 245 and communication between intake port 245 and drain 25 is blocked off. Further, handle 148 rotates to a position where it is flush with or below the plane of floor 11 within protective well 40. The closed status of the valve assembly is thus also indicated in the same manner as described with relation to the embodiment of FIGS. 6–10.

Figure 13:
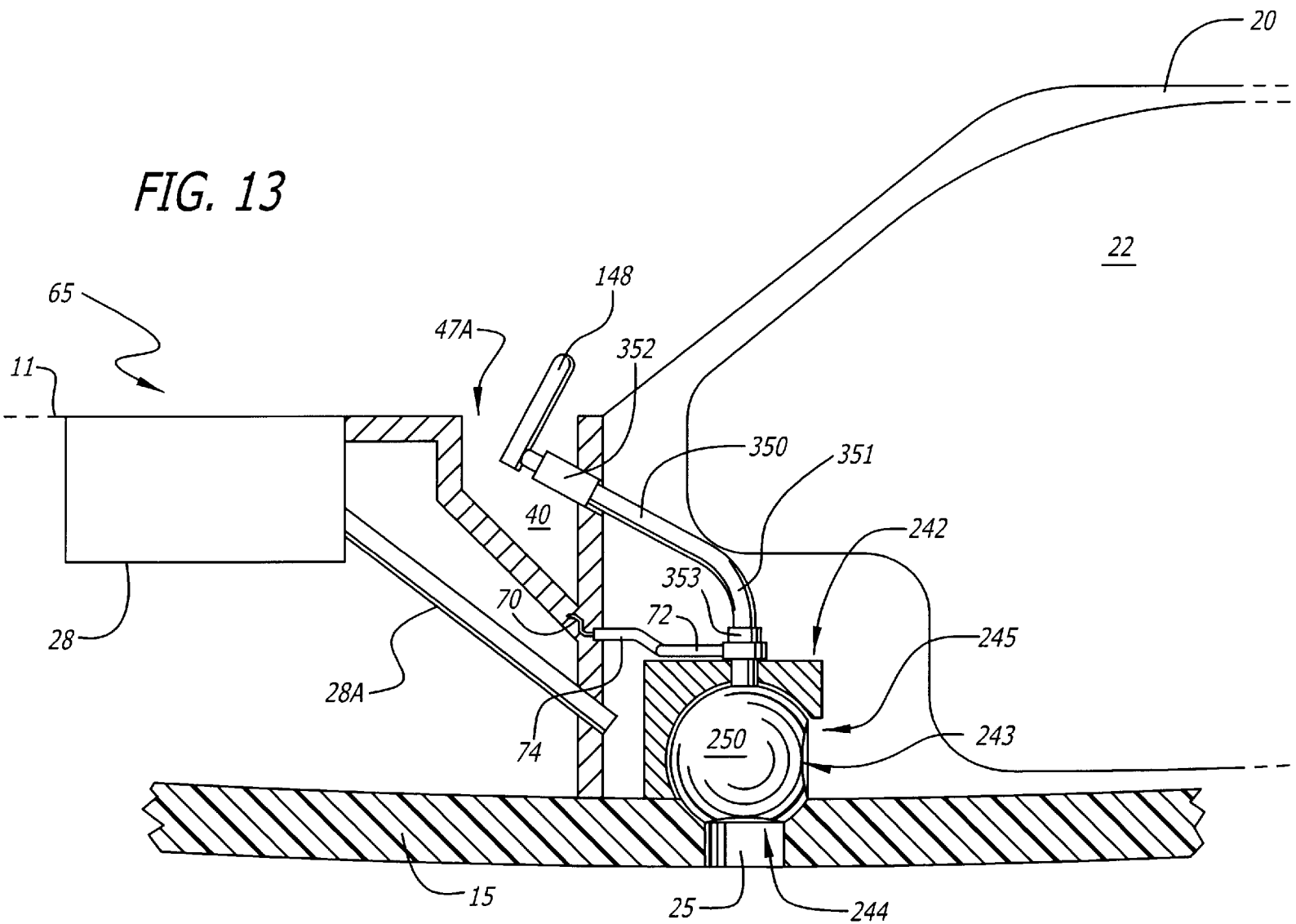
FIG. 13 is an enlarged side view of a valve well in partial cross section and valve components in an open configuration pursuant to a fourth embodiment of the bilge drainage system of the present invention.
Figure 14:
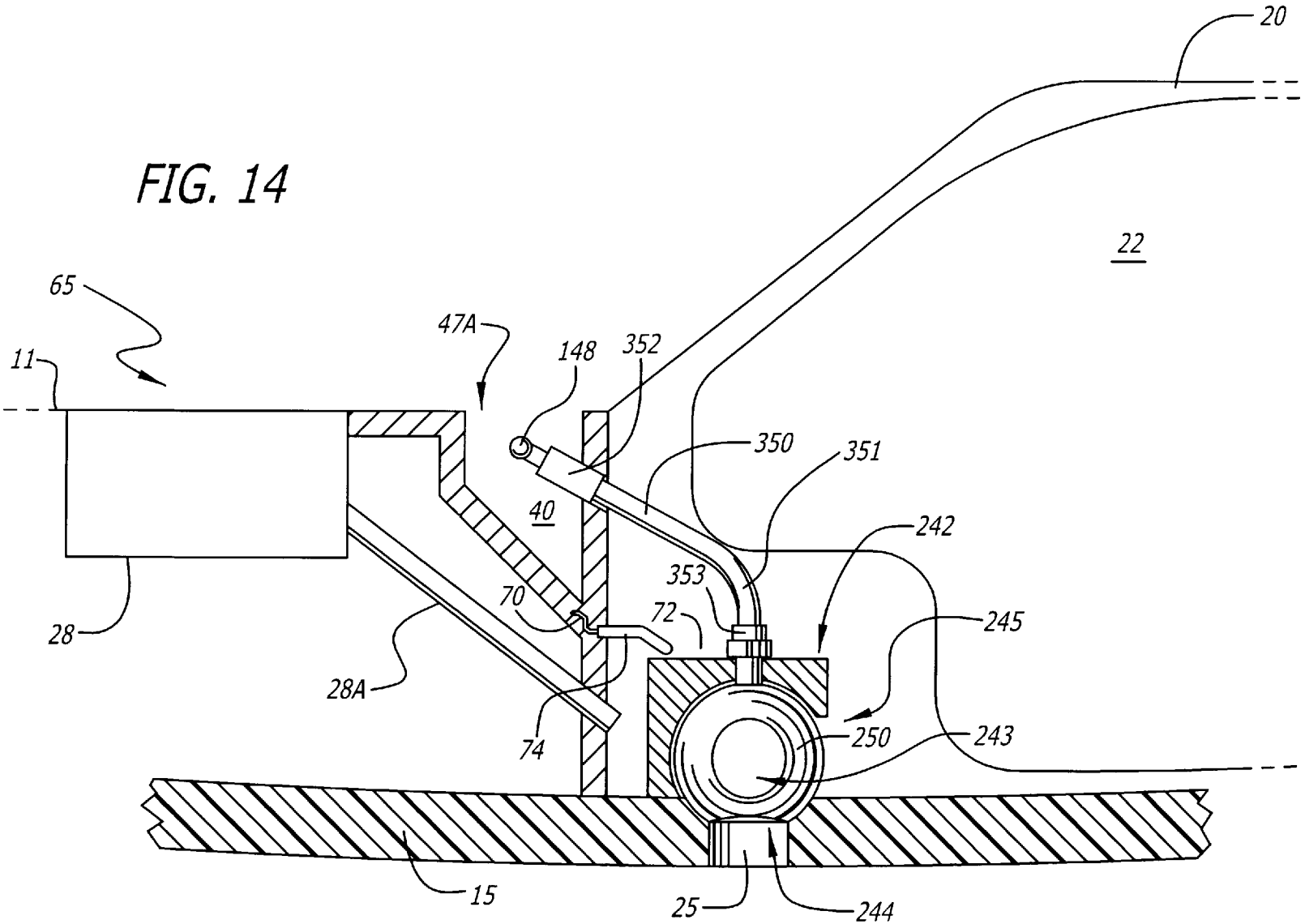
FIG. 14 is an enlarged side view of a valve well in partial cross section and valve components in a closed position pursuant to a fourth embodiment of the bilge drainage system of the present invention.

With reference to FIGS. 13 and 14, there is illustrated another embodiment of the present invention which leaves the drain opening unmoved from its prior art location while providing rotational drive of the valve assembly at an angle. This particular embodiment is similar in many respects to the embodiment previously discussed with reference to FIGS. 11 and 12, except for the mechanism interconnecting handle 148 and ball valve 250.

In the embodiment of FIGS. 13 and 14, handle 148 is connected to ball valve 250 through a flexible connector generally referred to at 350. Flexible connector 350 may be of any known construction. For example, as shown in FIGS. 13 and 14, flexible connector 350 may comprise a gooseneck type flexible shaft 351 mounted between handle 148 and ball valve 250 via conventional connecting elements 352 and 353. Movement of handle 148 between open and closed positions causes the flexible connector to rotate ball valve 250 between open and closed positions.

Alternatively, flexible connector 350 may be constructed of a flexible cable having one end connected to handle 148 and another end connected to ball valve 250 In this regard, the cable can be connected between handle 148 and ball valve 250 in any known manner to rotate the ball valve between open and closed positions. For example, and without being limitative, rotation of handle 148 can cause the cable to move in a linear fashion within cable housing 351, to rotate within cable housing 351, or to create a push or pull motion within cable housing 351. The only essential operation is that movement of handle 148 creates a corresponding movement of the cable that rotates the ball valve 250 in the desired direction between open and closed positions.

As shown in FIG. 13, when valve assembly 242 is open, handle 148 rotates to a position where at least a portion thereof protrudes above the plane of floor 11. The rotation of handle 148 causes flexible connector 350 to rotate ball valve 250 such that inlet opening 243 aligns with intake port 245 and outlet opening 244 aligns with drain 25. As shown in FIG. 14, when valve assembly 242 is closed, handle 148 rotates to a position where it is flush with or below the plane of floor 11 within protective well 40. Rotation of handle 148 causes flexible connector 350 to rotate ball valve 250 such that inlet opening 243 rotates circumferentially out of alignment with intake port 245 and communication between intake port 245 and drain 25 is prevented. The open or closed status of the valve assembly is indicated by the position of handle 148 in the same manner described with respect to the two immediately preceding embodiments.

With regard to the embodiments of FIGS. 11–14, an alarm activation mechanism can be employed in the identical manner as described with reference to the embodiment of FIGS. 6–10.

In yet another embodiment of the present invention, movement of the valve assembly may be controlled from a conventional dashboard arranged, for example, between a front window 31 and front passenger seats 32 and 33 of the boat shown in FIG. 4. In such an embodiment, a flexible connector such as that described in conjunction with the embodiment of FIGS. 13 and 14 is connected to and runs from the valve assembly under floor 11 of the boat to the dashboard, where it is connected, for example, to a push-pull handle or lever arranged on the dashboard. Operation of the push-pull handle or lever causes the cable of the flexible connector to open and close the valve assembly, in a similar manner to a conventional throttle mechanism known per se in the motor art. In this way, the valve assembly can be conveniently operated from a point both outside of the engine compartment 20 and within the easy reach of a seated boat operator.

As discussed, in a preferred embodiment of the present invention, the low point of the hull interior may be located adjacent to but outside of the engine compartment 20. In another embodiment of the present invention, valve apparatus 142 angles from a position outside engine compartment 20 to the aforedescribed low point which could be located underneath engine 22. It should be understood that handle 148 in this alternative embodiment would provide the requisite facilitation of access and use as in the previous embodiments even though angled or tilted, and provide the requisite visual indicia or cue as to the current status of drain 25.

It is believed that the operation and construction of the present invention will be apparent from the foregoing description and, while the invention shown and described herein has been characterized as particular embodiments, changes and modifications may be made therein without departing from the spirit and scope of the invention as defined in the following claims.

What is claimed is:

1. A bilge drainage system for an inboard motorboat having a hull, an engine compartment, and a drain for draining water from the engine compartment through the hull, said bilge drainage system comprising a rotatable drain closure assembly in communication with the drain, said drain closure assembly adapted to be rotated to a closed position and to an open position for controlling the flow of water from the interior of the engine compartment and from the interior of the hull to the exterior of the motorboat, a handle extending from said drain closure assembly having at least a portion thereof located outside of and adjacent to the engine compartment for rotating said drain closure assembly to the open and closed positions, and a rotational drive connected between said handle and said drain closure assembly for opening and closing said drain closure assembly when said handle is moved between the open and closed positions, said rotational drive comprising an articulated coupling connected between said handle and said drain closure assembly, whereby upon opening said drain closure assembly water from the engine compartment passes through said drain closure assembly and the drain from the interior of the hull to the exterior of the hull, and upon closing of said drain closure assembly no water passes through the drain.

2. The drainage system of claim 1, wherein said drain closure assembly includes a valve apparatus.

3. The drainage system of claim 2, wherein said valve apparatus includes a ball valve.

4. The drainage system of claim 2, wherein said valve apparatus includes a cone-shaped valve.

5. The drainage system of claim 1, wherein said drain closure assembly is located within the engine compartment.

6. The drainage system of claim 1, wherein at least a portion of the engine compartment is covered by an engine compartment cover, and wherein said drain closure assembly is located outside of the portion of the engine compartment that is covered by the engine compartment cover.

7. The drainage system of claim 5, wherein said drain closure assembly is a plug, and whereby opening said drain closure assembly is accomplished by removing said plug from said drain, and closing said drain is accomplished by reaffixing said plug to said drain.

8. The drainage system of claim 7, wherein said plug is threaded with a multipoint lead.

9. The drainage system of claim 1, wherein the position of said handle is indicative of the closure and opening of the drain by said drain closure assembly.

10. The drainage system of claim 1, further comprising an alarm actuator for activating an alarm when said drain closure assembly is open.

11. The drainage system of claim 10, further comprising means for manually deactivating said alarm without closing said drain.

12. The drainage system of claim 10, wherein said alarm comprises an audible signal.

13. The drainage system of claim 1, wherein said rotational drive comprises a flexible connector between said handle and said drain closure assembly.

14. The drainage system of claim 13, wherein said flexible connector comprises a flexible cable connected between said handle and said drain closure assembly.

15. The drainage system of claim 1, wherein the motorboat has a floor above the hull and the floor of the motorboat has an opening for permitting at least a portion of said handle to pass therethrough when in the open position.

16. An improved bilge drainage system for an inboard motorboat having a hull, an engine compartment, and a drain for draining water from the engine compartment through the hull, said bilge drainage system comprising a drain closure assembly in communication with the drain, said drain closure assembly having a closed position and an open position for controlling the flow of water from the interior of the engine compartment and from the interior of the hull to the exterior of the motorboat, wherein the motorboat has a floor above the hull and further comprises a well beneath the floor for housing said drain closure assembly, wherein said well has at least one opening through the floor for access to and operation of said drain closure assembly located outside of and adjacent the engine compartment and a handle with at least a portion thereof located outside of and adjacent to the engine compartment for opening and closing said drain closure assembly, whereby upon opening said drain closure assembly water from the engine compartment passes through said drain closure assembly and the drain from the interior of the hull to the exterior of the hull, and upon closing of said drain closure assembly no water passes through the drain.

17. The drainage system of claim 16, wherein said drain closure assembly includes a valve apparatus.

18. The drainage system of claim 17, wherein said valve apparatus includes a ball valve.

19. The drainage system of claim 17, wherein said valve apparatus includes a cone-shaped valve.

20. The drainage system of claim 16, wherein the drain closure assembly is located within the engine compartment.

21. The drainage system of claim 16, wherein at least a portion of the engine compartment is covered by an engine compartment cover, and wherein said drain closure assembly is located outside of the portion of the engine compartment that is covered by the engine compartment cover.

22. The drainage system of claim 16, wherein the position of said handle is indicative of the closure and opening of the drain by said drain closure assembly.

23. The drainage system of claim 16, further comprising an alarm actuator for activating an alarm when said drain closure assembly is open.

24. A bilge drainage system for an inboard motorboat having a hull, a floor above the hull, an engine compartment, and a drain for draining water from the engine compartment through the hull, said bilge drainage system comprising a drain closure assembly in communication with the drain, said drain closure assembly adapted to be moved to a closed position and to an open position for controlling the flow of water from the interior of the engine compartment and from the interior of the hull to the exterior of the motorboat, and a handle extending from said drain closure assembly with at least a portion thereof located outside of and adjacent to the engine compartment for moving said drain closure assembly to the open and closed position, at least a portion of said handle being elevated above the floor of the motorboat to provide a visual indication of the open position of said drain closure assembly, said handle being below the floor of the motorboat in the closed position, whereby upon opening said drain closure assembly water from the engine compartment passes through said drain closure assembly and the drain from the interior of the hull to the exterior of the hull, and upon closing of said drain closure assembly no water passes through the drain.

25. The drainage system of claim 24, wherein said drain closure assembly includes a valve apparatus.

26. The drainage system of claim 25, wherein said valve apparatus includes a ball valve.

27. The drainage system of claim 25, wherein said valve apparatus includes a cone-shaped valve.

28. The drainage system of claim 24, wherein the drain closure assembly is located within the engine compartment.

29. The drainage system of claim 24, wherein at least a portion of the engine compartment is covered by an engine compartment cover, and wherein said drain closure assembly is located outside of the portion of the engine compartment that is covered by the engine compartment cover.

30. The drainage system of claim 24, further comprising an alarm actuator for activating an alarm when said drain closure assembly is open.

* * * * *

UNITED STATES PATENT AND TRADEMARK OFFICE

CERTIFICATE OF CORRECTION

PATENT NO. : 6,338,309 B1
DATED : January 15, 2002
INVENTOR(S) : Gary K. Michelson It is certified that error appears in the above-identified patent and that said Letters Patent is hereby corrected as shown below:

Column 9,
Line 63, change "5" to -- 6 --.

Signed and Sealed this

Twenty-seventh Day of August, 2002

*Attest:*

*Attesting Officer*

JAMES E. ROGAN
*Director of the United States Patent and Trademark Office*